US006782669B1

(12) United States Patent
Dixon

(10) Patent No.: US 6,782,669 B1
(45) Date of Patent: Aug. 31, 2004

(54) FURNACE LINING

(75) Inventor: Thomas Gildroy Shaw Dixon, Worcestershire (GB)

(73) Assignee: F. C. S. Dixon Limited, Cannock (GB)

( * ) Notice: Subject to any disclaimer, the term of this patent is extended or adjusted under 35 U.S.C. 154(b) by 0 days.

(21) Appl. No.: 09/744,375

(22) PCT Filed: May 17, 1999

(86) PCT No.: PCT/GB99/01565

§ 371 (c)(1),
(2), (4) Date: Feb. 5, 2001

(87) PCT Pub. No.: WO00/05543

PCT Pub. Date: Feb. 3, 2000

(30) Foreign Application Priority Data

| | | |
|---|---|---|
| Jul. 24, 1998 | (GB) | 9816091 |
| Sep. 7, 1998 | (GB) | 9819294 |
| Sep. 25, 1998 | (GB) | 9820786 |

(51) Int. Cl.[7] ..... F27D 1/10; E04B 2/04

(52) U.S. Cl. ..... 52/506.02; 52/406.2; 52/404.2; 52/509; 52/512; 110/336; 110/338

(58) Field of Search ..... 52/699, 406.2, 52/404.2, 506.02, 509, 512, 747.1; 110/336, 338

(56) References Cited

U.S. PATENT DOCUMENTS

| | | | | |
|---|---|---|---|---|
| 3,819,468 A | * | 6/1974 | Sauder et al. | 161/152 |
| 4,103,469 A | | 8/1978 | Byrd, Jr. | |
| 4,381,634 A | * | 5/1983 | Hounsel et al. | 52/506 |
| 4,494,295 A | * | 1/1985 | Herring | 29/432 |
| 4,584,814 A | * | 4/1986 | Hounsel et al. | 52/747 |
| 4,803,822 A | * | 2/1989 | Deren | 52/506 |
| 4,848,055 A | * | 7/1989 | Wade | 52/506 |
| 4,850,171 A | * | 7/1989 | Deren | 52/506 |
| 4,885,890 A | * | 12/1989 | Deren | 52/506 |
| 4,928,466 A | * | 5/1990 | Alexander | 52/509 |
| 5,010,706 A | * | 4/1991 | Sauder | 52/506 |
| 5,353,567 A | * | 10/1994 | Knight et al. | 52/506.03 |
| 5,438,813 A | | 8/1995 | Wade | |
| 5,759,663 A | | 6/1998 | Hounsel | |
| 5,802,794 A | | 9/1998 | Robson | |

FOREIGN PATENT DOCUMENTS

| | | |
|---|---|---|
| AU | 481101 | 9/1975 |
| DE | 4119990 | 12/1992 |
| EP | 0695923 | 2/1996 |
| FR | 1375770 | 9/1964 |
| GB | 2006413 | 5/1979 |
| GB | 2149771 | 6/1985 |

* cited by examiner

*Primary Examiner*—Carl D. Friedman
*Assistant Examiner*—Yvonne M. Horton
(74) *Attorney, Agent, or Firm*—MacMillan, Sobanski & Todd, LLC

(57) ABSTRACT

A lining (10) for a furnace the lining (10) having insulating material (12) attached to an inside wall (11) of the furnace, the insulating material (12) in use having a hot face (20) which faces inwardly of the furnace, and a cold face at or adjacent the furnace wall (11) characterized in that a protective element (26) is provided at least partially to cover the hot face (20), and/or the cold (C) face, the protective element (26) being secured relative to the face by a securing means (27, 27*b*), which co-operates with a member (25, 25*a*; 25*b*; 25*c*) which is embedded in the insulating material (12).

7 Claims, 6 Drawing Sheets

FIG 4
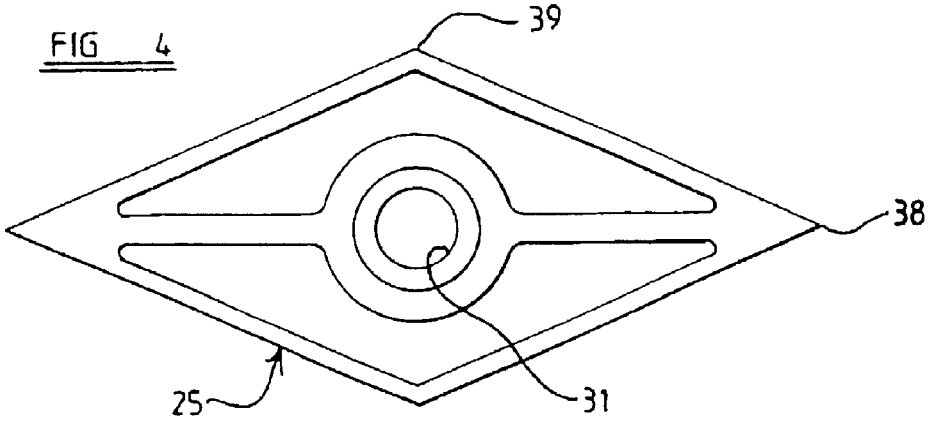
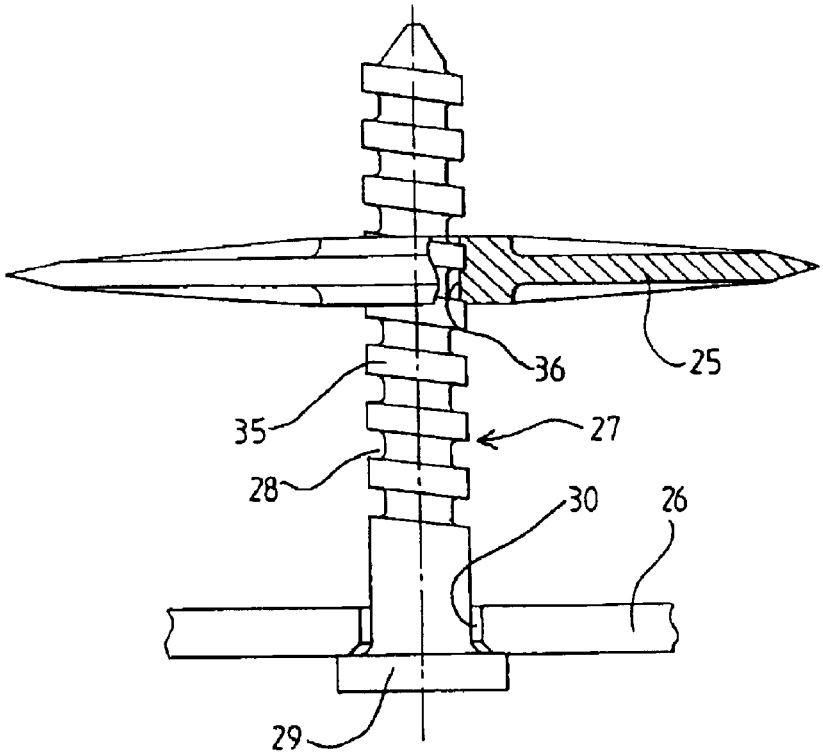
FIG 3

FURNACE LINING

This invention relates to a furnace lining. By "furnace" we mean a furnace, kiln, oven or the like where there is a chamber which is heated, and into which articles are placed for heat treatment.

Furnaces tend to be dusty, particularly where there is provided a fan or high velocity burner or the like for circulating hot air within the furnace, and dust is undesirable, particularly in the case of a kiln in which ceramic articles/glazes are fired, or in an oven where vitreous enamel is baked dry. The problem of dust is aggravated where there is provided an insulating lining which is of a fibrous nature which may contain silica, which may also present a potential health hazard if the fibres become airborne.

To reduce the amount of dust contributed by the furnace lining it is common to cover the lining with a protective covering such as high-temperature resistant textile material which is attached to the lining e.g. by pins. Another approach is to cement anchors into the fibres of the insulating lining.

Yet another approach is to attach to the hot face of the lining, i.e. the face of the lining facing inwards of the furnace, ceramic plate-like members. This is used where the underlying lining requires protection from deleterious atmospheres, e.g. aggressive gases such as vanadium pentoxide which can eat away the fibrous lining material.

This latter approach provides the advantage that the ceramic plates, being generally rigid, may be used as supports for, for example, heating elements. Such ceramic plates are typically attached to the hot face with a cement material, but the adhesive effect of such cements tends to deteriorate in use with the effect that the ceramic plates separate from the insulating lining. It will be appreciated that a falling ceramic plate can cause substantial damage to articles in the kiln, particularly where the ceramic plate is attached to the lining of a roof of the kiln, and results in damage occurring to the lining.

More expensive furnace lining materials are known such as that sold under the name "Saffil". These do not contain silica but are about 90% alumina based fibrous insulation. Another alternative is a glass based fibre such as "Superwool".

As these do not contain silica, they are not subject to health and safety legislation controlling the use of silica based materials. Saffil is a more expensive furnace lining material than silica based materials and Superwool, and thus tends only to be used in environments where higher temperatures are experienced. Hence for economy's sake, the furnace lining has to be designed with the temperature to which the furnace is to be heated in mind, and once designed there is, conventionally, little scope for improving the thermal resistance of the lining.

In some circumstances it is desirable to have a protective element at the cold face between the furnace wall and the furnace lining.

According to a first aspect of the invention we provide a lining for a furnace the lining having insulating material attached to an inside wall of the furnace, the insulating material in use having a hot face which faces inwardly of the furnace and a cold face at or adjacent the furnace wall, characterised in that a protective element is provided at least partially to cover the hot and/or the cold face, the protective element being secured relative to the face by a securing means which co-operates with a member which is embedded in the insulating material.

Thus particularly but not exclusively where the protective element is secured relative to the hot face of the insulating material the invention may provide the advantage of a conventional furnace lining which comprises a protective ceramic plate or plates attached to the hot face of the insulating material, but the manner by which the ceramic plate is attached is more secure than a simple cement attachment.

It is envisaged that a ceramic plate type protective element may be attached by both adhesive cement and the securing means/embedded member so that in the event that the cement fails, the co-operation between the securing means/embedded member will prevent the protective element becoming detached from the face of the insulating material, and vice versa.

Alternatively, the advantages of non-silica containing insulating materials may be provided by attaching one or more layers of non-silica containing material, e.g. in the form of a blanket, to a conventional silica-containing insulating material lining. Thus an existing lining may be adapted for use in higher temperature applications by applying a layer of Saffil or the like particularly to the hot face of the insulating material, as the higher grade, non-silica containing material is tolerant to higher surface temperatures.

Where the lining does not require upgrading but it is desired to provide a protective element to isolate the silica containing materials, a layer of Superwool or the like may be attached.

Where it is desired to do so, a layer or layers of conventional silica-containing lining materials may be added to the hot face of the insulating material of an existing lining structure, to upgrade the lining, although some means to protect the silica-containing lining materials from becoming airborne may be necessary to comply with health and safety legislation.

In one embodiment the securing means comprises a headed fastener a shank of which co-operates with the embedded member. For example, most conveniently the shank of the headed fastener has provided thereon, a screw thread, e.g. a male screw thread, and the embedded member includes a corresponding opposite screw thread, e.g. female threaded opening, with which the shank is in use engaged. Thus the fastener may be unscrewed for maintenance of the lining as and when required. However it is envisaged that the shank of the headed fastener may otherwise co-operate with the embedded member to attach the protective element at the respective face.

The shank of the threaded fastener may pass through a passage of the protective element into co-operation with the embedded member. For example, the passage may comprise a pre-formed opening through the protective element or a cut-out at a side of the protective element as desired.

Of course, in the construction of the first embodiment of the invention where the protective element is provided at the hot face, the headed fastener will be subjected to the heat within the furnace and so preferably the fastener is made at least substantially, and preferably totally, of a ceramic material. In low temperature environments though or at the cold face, the fastener could be made of, for example, nickel chrome or another suitable metal.

In another embodiment, the embedded member comprises an integral shank or is adapted to have a shank secured thereto, and the securing means is engageable with the shank to secure the protective element to the respective face.

Either the securing means or the shank may pass through the protective element for securing to the shank or the securing means respectively.

In each case, whether the protective element is secured to the hot or the cold face, because the securing means co-operates with the embedded member, there is no path for the conduction of heat from the hot to the cold face and hence to the inside furnace wall, via the securing means.

The protective element is preferably as light as possible and may conveniently be of plate-like configuration, made at least substantially and preferably totally, of a ceramic material. However, the protective element could comprise a blanket of silica free insulation such as Superwool or a high-temperature resistant textile material, and/or a higher temperature resistant high alumina insulation than other insulating material of the lining.

However, the protective element could comprise additional layers of the same insulating material as that from which the remainder of the lining is made.

Whether the protective element is provided at the hot and/or cold face a furnace lining typically includes a plurality of individual blocks or modules of insulating material, each attached at the inside wall of the furnace. For example, each module may comprises a ceramic blanket which is folded to a block-like shape, with the folds extending transversely to the furnace wall.

The member with which the fastener co-operates may be embedded in at least one of the individual blocks during manufacture of the block and may be arranged to as to extend generally transversely to the folds.

The embedded member may have an integral shank or may be adapted to have a shank secured thereto. In either case, instead of being embedded in the block during manufacture of the block, the embedded member may be embedded in the lining by being forced into the lining material and then being rotated.

For example the embedded member may be generally elongate or may have a generally elongate part or parts. Each block may comprise a ceramic blanket which is folded to a block-like shape, with the folds extending transversely to the furnace wall. The embedded member may be forced into the insulating material with an elongate axis thereof or of the elongate part in an orientation generally aligned with the folds and is then rotated generally about an axis which is transverse to the elongate axis so that the elongate axis extends generally transverse to the folds.

The embedded member may be thin e.g. of a single plate or multiple plate-like construction, and may be made substantially or totally of a ceramic material or another suitable material which is sufficiently strong to resist pull-out forces.

Whereas the protective element may comprise a single layer construction, the protective element may comprise a plurality of layers which may or may not be bonded together.

The protective element, or where the protective layer comprises single layers of e.g. ceramic, the protective element may additionally be secured relative to the hot or cold face by adhesive cement.

According to a second aspect of the invention we provide a lining for a furnace the lining including insulating material attached at an inside wall of the furnace, the insulating material in use having a hot face which faces inwardly of the furnace and a cold face at or adjacent the furnace wall, characterised in that a protective element is provided at least partially to cover the hot and/or the cold face, the protective element being secured relative to the face by means including a headed fastener, a shank of which co-operates with a member which is embedded in the insulating material.

According to a third aspect of the invention we provide a lining for a furnace having insulating material attached at an inside wall of the furnace, the insulating material in use having a hot face which faces inwardly of the furnace and a cold face at or adjacent the furnace wall, characterised in that a protective element is provided at least partially to cover the hot and/or the cold face, the protective element being secured relative to the face by means including a member which is embedded in the insulating material and a securing means which is attached to a shank which is integral with the embedded member or is attached to the embedded member, the shank or the securing means passing through the protective element into engagement with the embedded member or the securing means.

According to a fourth aspect of the invention we provide a method of lining a furnace wall comprising the steps of attaching insulating material to the wall of the furnace, the insulating material in use having a hot face which faces inwardly of the furnace and a cold face at or adjacent the furnace wall, characterised in that the method comprises embedding in the insulating material, a member which is adapted to co-operate with a securing means, providing a protective element at least partially to cover the hot and/or cold face, securing the protective element to the face by attaching the securing means to the embedded member.

Where the securing means comprises a headed fastener, the method may include inserting a shank of the headed fastener through the protective element into the insulating material so that the shank may co-operate with the embedded member.

The shank of the headed fastener may co-operate with the embedded member by rotating the shank relative to the embedded member so that a screw thread of the shank engages with a corresponding screw thread of the embedded member although other methods of co-operation may alternatively be employed.

In a typical furnace lining construction the insulating material is attached to the furnace wall by a fixing means which is operated on from the hot face of the material, using a tool which is passed through the insulating material in an opening from the hot face of the material. For example a self-drilling fastener of the fixing means may be driven into the furnace wall by being rotated using a tool which is inserted through the fibrous insulating material, thus creating an opening therethrough, and the tool is operated from the hot face of the insulating material. Alternatively, a fastener of a fixing means or the fixing means itself may be welded to the inside furnace wall, using a welding tool which is inserted through the fibres of the lining, thus creating an opening therethrough.

The method of the invention may include inserting the shank of the fastener through the opening into co-operation with the embedded member so that there is no need to provide an additional opening to receive the shank of the headed fastener.

Instead of the securing means comprising a headed fastener a shank of which co-operates with the embedded member, the embedded member may comprise an integral shank, or the method may include attaching a shank to the embedded member, and the method may include engaging the securing means and the shank to secure the protective element to the hot and/or the cold face.

The method may further include positioning the protective element at the hot or cold face of the insulating material and either passing the shank which is integral or attached to the embedded member through the protective element or passing the securing means through the protective element and engaging the securing means and the shank so that the protective element is retained between the securing means or a part thereof and the face.

The embedded member may be embedded in the insulating material during manufacture of the block or may be embedded in the insulating material by forcing the member into the insulating material and then rotating the member so that the member may cut or divide the insulating material and be anchored therein.

The furnace lining may be modular comprising a plurality of modules or blocks of insulating material, and the method may be characterised in that a substantial part of the furnace wall is covered by a plurality of protective elements each secured at the hot face of the insulating material at least one an individual module, by means including a securing means which co-operates with a member which is embedded in the insulating material.

Where the insulating material is formed with folds which extend transversely to the furnace wall, the method may include inserting the member to be embedded when in an orientation generally aligned with the folds so as to cause minimum disruption to the insulating material as the member is forced in, and then rotating the member so that the member extends transversely to the folds.

In one arrangement, the member to be embedded includes a shank and the member is rotated by using the shank as a tool, although alternatively the member may be rotated using a tool which co-operates with the member and is subsequently removed from the insulating material.

According to a fifth aspect of the invention we provide a method of lining a furnace wall comprising the steps of attaching insulating material to the wall of the furnace, the insulating material in use having a hot face which faces inwardly of the furnace and a cold face at or adjacent the face wall, characterised in that the method comprises embedding in the insulating material, a member which is adapted to co-operate with a shank of a headed fastener, providing a protective element at least partially to cover the hot or the cold face, securing the protective element to the face by inserting the shank of the headed fastener though the protective element into the insulating material, so that the shank may co-operate with the embedded member.

According to a sixth aspect of the invention we provide a method of lining a furnace wall comprising the steps of attaching insulating material to the wall of the furnace, the insulating material in use having a hot face which faces inwardly of the furnace and a cold face at or adjacent the furnace wall, characterised in that the method comprises embedding in the insulating material, a member which is adapted to co-operate with a securing means, providing a protective element at least partially to cover the hot or cold face, securing the protective element to the face by attaching the securing means to the embedded member such that the protective element is retained between the securing means or a part thereof, and the face.

At the hot face, at least where the protective element or elements are not cemented to the lining, it will be appreciated that by virtue of the protective element(s) being secured relative to the hot face by co-operation between the embedded member and the securing means, the protective elements may be removed subsequently to facilitate maintenance of the lining, such as the addition of layers required to repair mechanical and/or temperature damage to the lining.

Thus according to an seventh aspect of the invention we provide a method of repairing a lining of a furnace made by the method of the fourth, fifth or sixth aspects of the invention including the steps of removing the securing means, removing the protective element or a layer of the protective element, and securing a replacement protective element or protective element layer, to the face of the insulating material by a securing means which co-operates with a member which is embedded in the insulating material.

Where a furnace is lined with a lower grade insulating material and it is desired to improve either the thermal resistance of the lining or its tolerance of high temperature, this may readily be achieved either by replacing the protective element in use with a higher grade protective element where the invention is already employed, or adding one or more layers to the protective element, or the lining below the protective element.

According to an eight aspect of the invention we provide a method of improving the thermal resistance of an existing furnace lining having insulating material attached to an inside wall of the furnace, the insulating material in use having a hot face which faces inwardly of the furnace and a cold face at or adjacent a furnace wall and the insulating material having embedded thereon a member which is adapted to co-operate with a securing means the method being characterised in that a protective element is provided at least partially to cover the hot or cold face, the protective element being secured relative to the hot or cold face by the securing means co-operating with the member which is embedded in the insulating material.

Thus provided that an embedded member is provided in the insulating material of the lining, an existing lining may be upgraded with minimal disturbance of the lining.

The invention will now be described with reference to the accompanying drawings in which:

FIG. 3 is an enlarged side view showing a headed fastener of the embodiment of FIG. 1 in co-operation with an embedded member;

FIG. 4 is a front view of the embedded member of FIG. 3;

Figure 6:
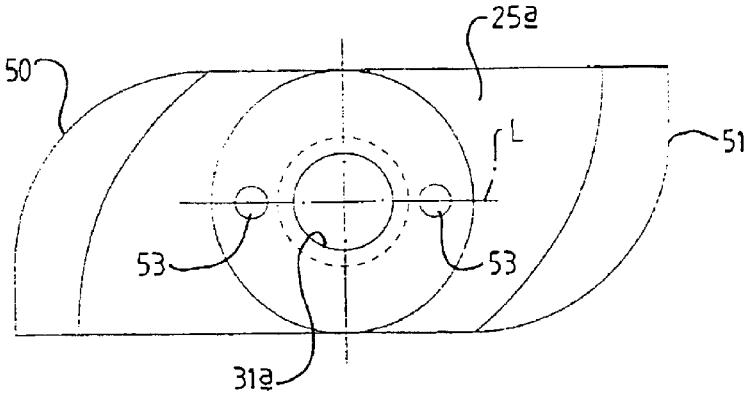
FIG. 6 is a front view of an alternative embedded member.
Figure 6A:
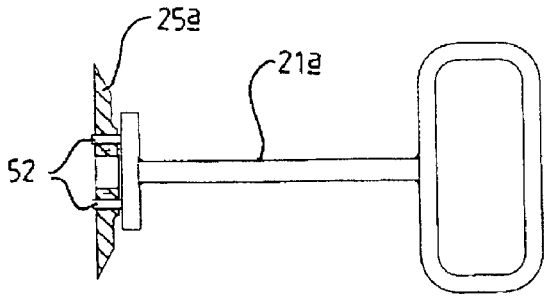

FIG. 6*a* is an illustrative view showing how a tool is used to insert an embedded member into insulating material.

Figure 7:
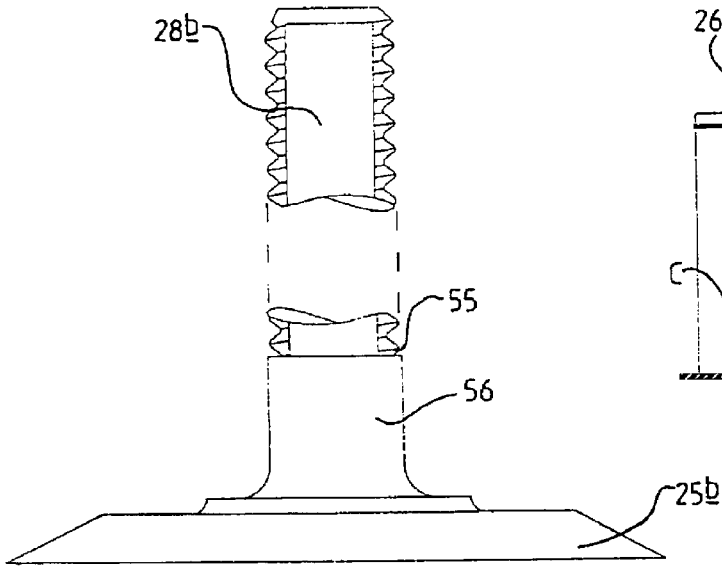
Figure 7A:
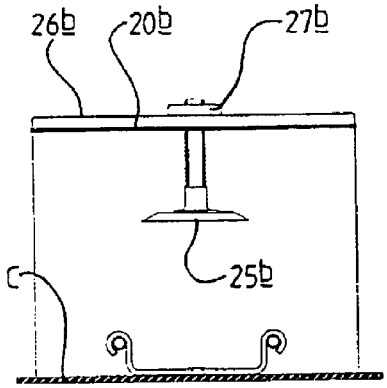

FIG. 7 is a side view of an alternative embedded member with a shank attached;

FIG. 7*a* is an illustrative view of the member of FIG. 7 in use.

Figure 8:
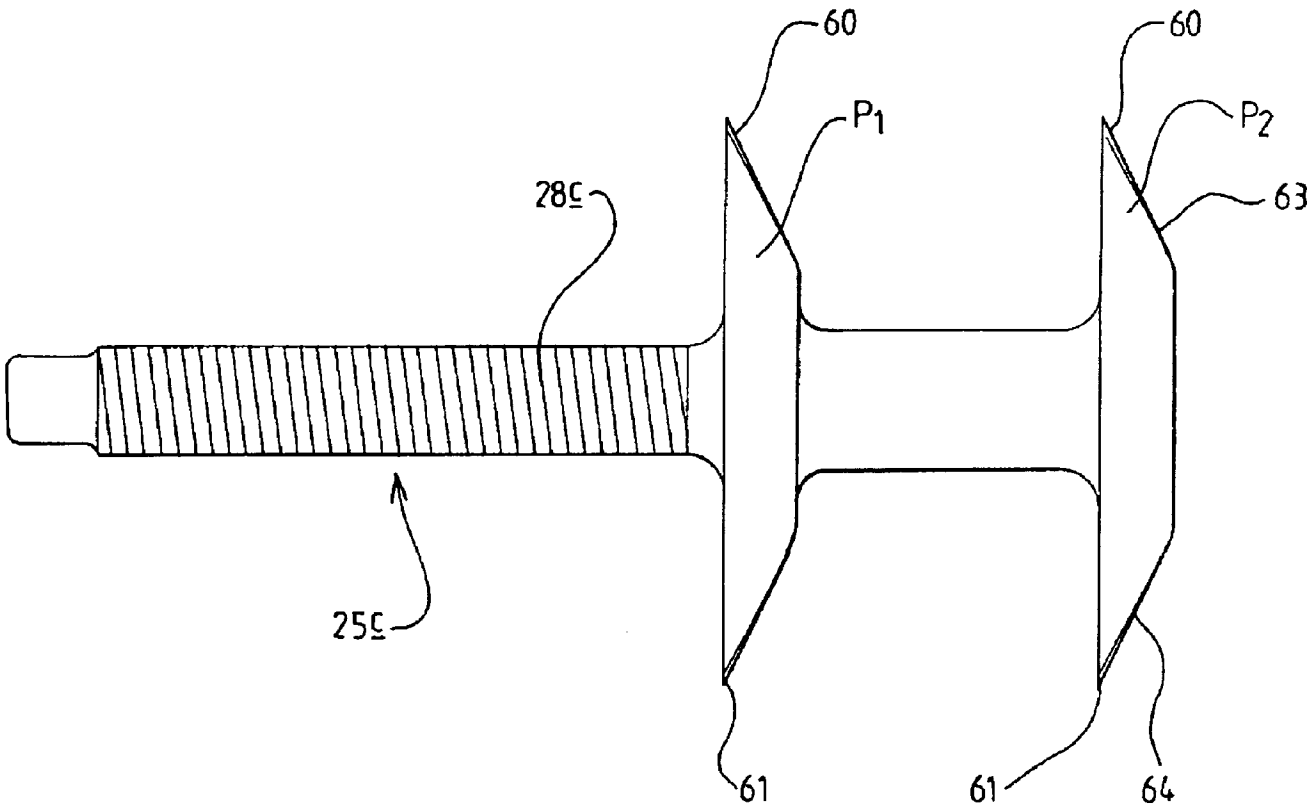

FIG. 8 is a side view of an alternative member adapted to be embedded.

Figure 8A:
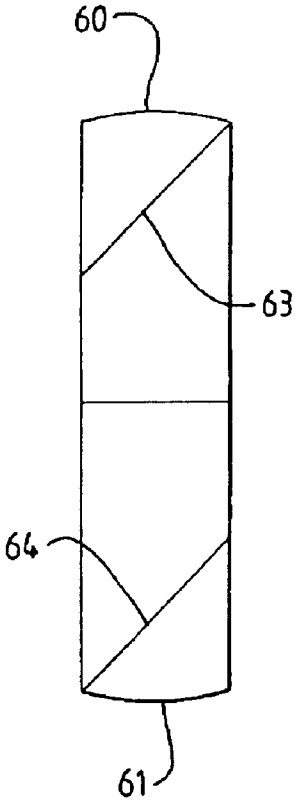

FIG. 8*a* is a plan view of the member of FIG. 8.

Figure 1:
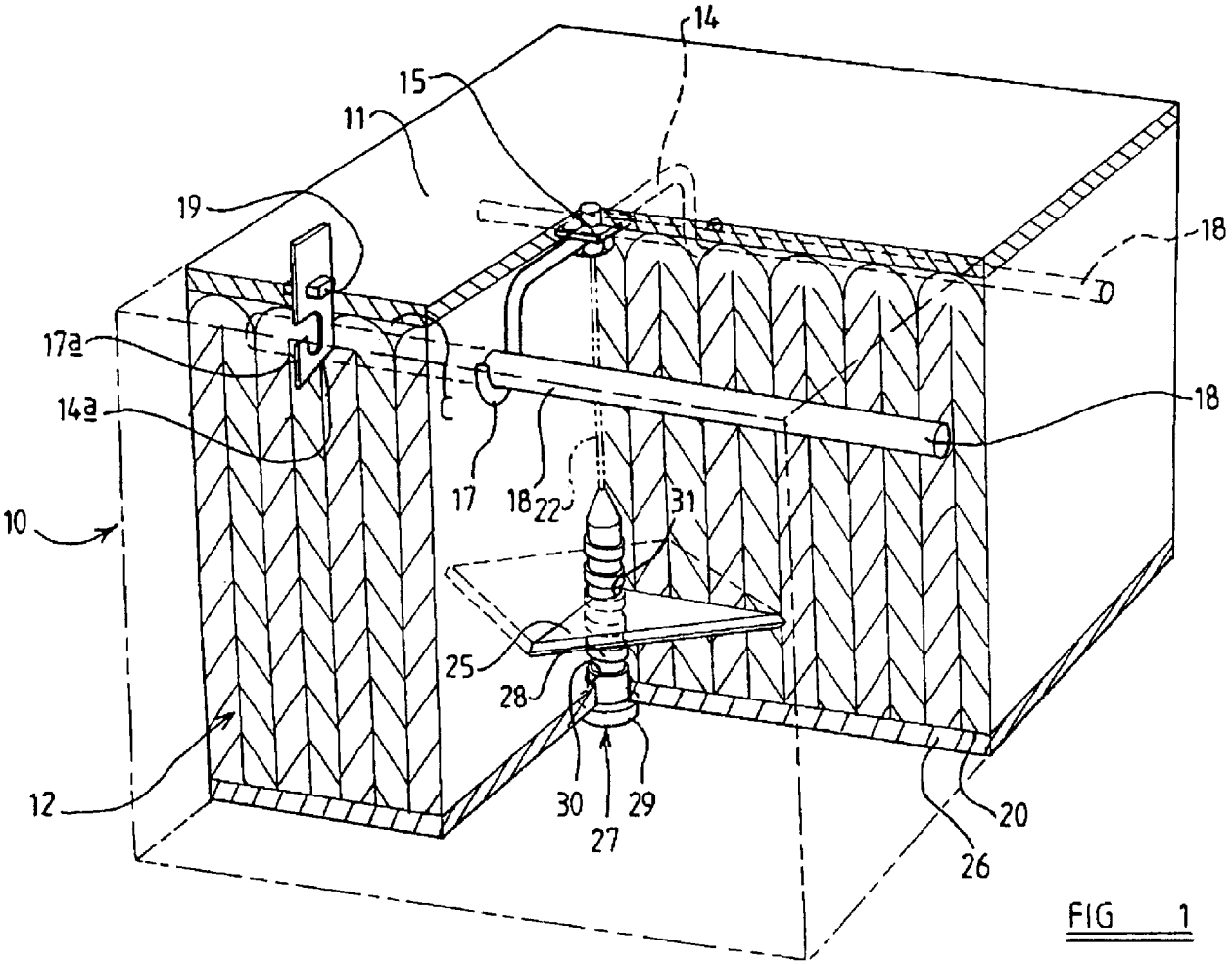
FIG. 1 is an illustrative perspective view from above and to the side of part of a furnace wall lining in accordance with the invention partly broken away to reveal hidden features, and showing two alternative ways of attaching insulating material to a furnace wall.

Referring to FIG. 1 of the drawings, part of a furnace lining construction 10 is shown. Part of a furnace wall is indicated at 11, and may comprise part of the roof or a side wall of the furnace.

The furnace wall 11 may comprise a simple steel panel wall, or may be provided by a metal or other mesh. To protect the furnace wall 11 in use, from the high temperatures within the furnace, the furnace is lined with insulating material which typically comprises a plurality of individual blocks or modules of insulating material, one of which is indicated at 12.

The thickness of the module 12 will depend on the temperatures to be generated in the furnace, and the degree of thermal resistance required to protect the furnace wall 11.

The modules 12 are typically made from a fibrous blanket of insulating material, such as an alumina/silicate based fibre, which is folded as indicated in FIG. 1 and compressed to shape and held by rods 18 which extend transversely to the folds, generally parallel to the furnace wall 11. The folds may be trimmed at the face remote from the furnace wall 11, to provide a substantially flat hot face 20 where a protective layer 26, is to be cemented to the fibres of the module 12. A fixing 14 may be embedded in the module 12 as the module 12 is made or subsequently. The folds are preferably arranged to extend transversely to the furnace wall 11.

The modules 12 are attached relative to the furnace wall 11 by fixings the nature of which will depend on the module construction and the nature of the furnace wall 11.

At the right hand side of FIG. 1 a fixing particularly suitable for a construction where the furnace wall 11 is a steel panel is shown. The fixing 14 is attached by one or more fasteners 15 to the furnace wall 11, the fixing 14 having a hooked part 17 which is embedded in the fibres of the module 12 in a position where the fixing rod (or tube) 18 is inserted through the folds to co-operate with the hooked part 17. The rod 18 may co-operate with a plurality of fixings 14 attaching modules 12 to the inside of the furnace wall 11 but preferably and usually, each module 12 will have its own rod 18 or rods (or tubes).

At the left hand side of the figure a fixing 14*a* is shown which is more suited to a furnace wall 11 construction which comprises a mesh. The fixing 14*a* is inserted through the mesh wall 11 to a position where a hooked part 17*a* is engageable by a rod 18 (or tube). The fixing 14*a* has a transversely extending part 19 which prevents the fixing 14*a* passing entirely through the mesh wall 11.

Figure 5:
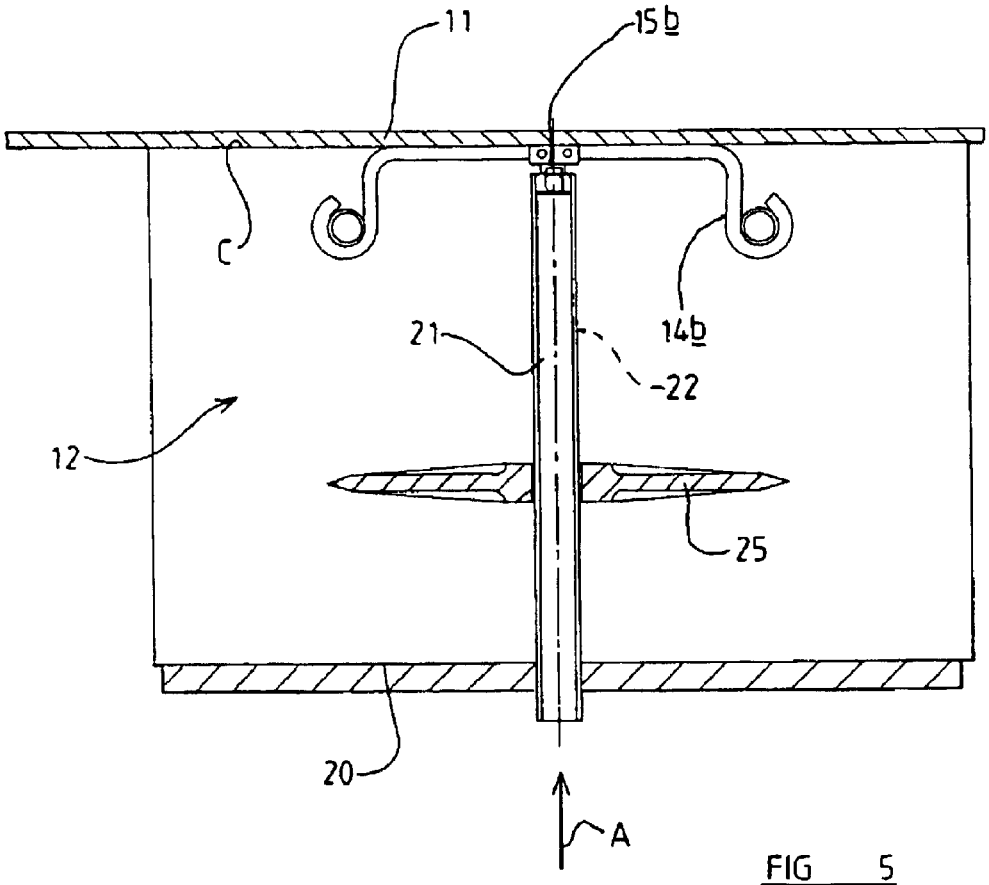
FIG. 5 is an illustrative view of the embodiment of FIG. 1 at a stage during construction, showing the insulating material simply.

Any other fixing for attaching the modules 12 to the furnace wall 11 may be employed. However, referring to FIG. 5, one particularly suitable fixing method, for use in conjunction with the present invention is illustrated. A fixing 14*b* similar to the fixing 14 of FIG. 1 is embedded in the module 12 during manufacture of the module 12 or subsequently, and is attached to the furnace wall 11 (in this case a steel panel) by one or more fasteners 15*b* which are operated upon from the distant inside, so called hot, face 20 of the module 12. This is achieved by passing a suitable fixing tool 21 through the material of the module 12 in the direction indicated by arrow A. Inserting the tool 21 through the material of the module 12 creates an opening 22 through the module 12 for a use hereinafter to be explained as indicated in dotted lines in FIG. 1. It will be noted in FIG. 5 that the tool 21 has to pass through a member 25 which is embedded in the module 12.

The tool 21 may be hollow so as to "core" the module 12, but due to the fibrous nature of the insulating material, when tool 21 is removed, the opening 22 will substantially closed.

Alternatively, the fixing 14*b* could be attached to the inside of the furnace wall by welding using a suitable tool inserted through the fibres of the module 12, or by any other desired means.

Referring again to FIG. 1, to provide a covering for the hot face 20 of the module 12, to deter dust circulation within the furnace and to provide physical protection for the fibrous material of the module 12, a protective element 26 is secured at the hot face 20 of the insulating lining material. In this example, the protective element 26 comprises a cordierite bat, which is a ceramic based material. Conventionally, such protective elements 26 are simply cemented in position during manufacture of the modules 12, although may be cemented in position once the modules 12 have been attached to the furnace wall 11.

In accordance with the invention, alternatively or additionally, the protective element 26 is secured at the hot face 20 of the modules 12 by a securing means comprising in this embodiment a headed fastener 27, a shank 28 of which is adapted to co-operate with the member 25 which is embedded in the material of the module 12. The fastener 27 has a head 29 which is larger than a pre-formed passage 30 through the protective element 26, whilst the shank 28 passes through the passage 30 into co-operation with the member 25. The member 25 has an opening 31 to receive the shank 28, which opening 31 is larger than the external dimension of the fixing tool 21 by which the fixing 14*b* is attached to the furnace wall, as described above with reference to FIG. 5.

Referring also now to FIGS. 3 and 4, it can be seen that the shank 28 of the fastener 27 has a coarse male thread 35, whilst the opening 31 through the embedded member 25 has a corresponding female thread 36 so that the fastener 27 co-operates with the embedded member 25 by turning the fastener 27 with a suitable tool to engage with e.g. the head 29 of the fastener 27, and thus screwing the shank 28 of the fastener 27 into the embedded member 25.

Because the fastener 27 is in use subjected to the temperatures within the furnace, the fastener 27 is made of a suitable heat resistant material such as a ceramic based material although in a lower temperature application the fastener 27 could be made of nickel chrome or another suitable metal. The embedded member 25, although protected to some degree from the heat generated in the furnace, may also be made of ceramic or similar material, but may be made of metal or another material as desired in a lower temperature application. It will be appreciated that the embedded member 25 may be positioned at an optimum distance from the hot face 20 irrespective of the thickness of the modules 12.

The screw thread 35 of the shank 28, and the corresponding thread 36 of the embedded member 25 are preferably coarse so that only one, two or three thread pitches engage, to reduce the risk of the threads binding, whilst providing adequate resistance to the fastener 27 unscrewing as a result of vibrations experienced in use.

The embedded member 25 preferably has points 38,39 to facilitate its insertion through the folds of the material of the module 12 during construction of the module 12, but otherwise is preferably plate-like and of sufficient strength to provide a substantial resistance to pull out forces. Many alternative configurations to that shown in FIG. 4 are possible.

Referring back to FIG. 1 it will be appreciated that the thickness of the module 12 from the furnace wall 11 to the hot face 20 may vary to suit particularly furnace constructions. Because the fastener 27 engages with the embedded member 25, the position of which can be the same relative to the hot face 20 whatever the module 12 thickness, it is possible for a single length fastener 27 to be used in a wide variety of applications so that it is unnecessary to produce a range of fasteners of different length.

Various modifications are possible without departing from the scope of the invention.

Figure 2:
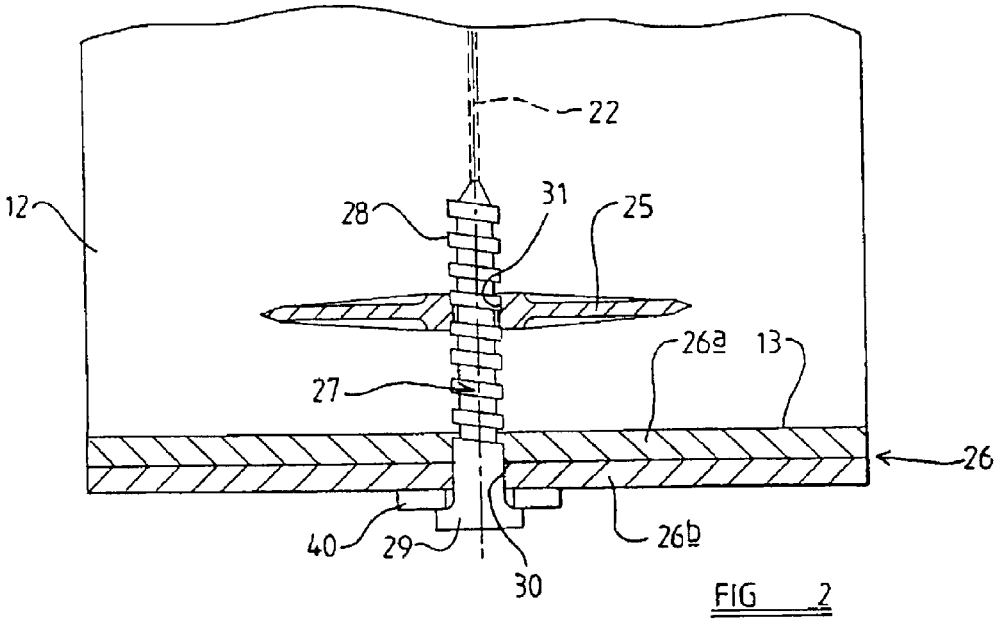
FIG. 2 is an illustrative view similar to FIG. 1 but showing an alternative embodiment, and omitting the furnace wall and showing the insulating material in a simplified manner.

For example as shown in FIG. 2, where similar parts to those shown in FIG. 1 are indicated by the same reference number, the protective element 26 does not comprise a single layer of material, but comprises a plurality of layers

26*a,* 26*b* of e.g. a silica free fibrous material, which may cover a single module 12, or a plurality of modules 12 as desired. In FIG. 2 the inner and outer layers 26*a,* 26*b* are attached to the insulating material of the module 12 by the fastener 27 and embedded member 25, making the replacement of the outer or both of the protective element layers 26*a,* 26*b* readily possible e.g. to replace a deteriorating outer layer 26*b* with a new layer 26*b* and/or to upgrade the thermal resistance of the lining by providing a higher grade layer 26*b* than before. Also in FIG. 2, a ceramic washer 40 is shown between the head 29 of the fastener 27 and the protective element 26, which may be required depending on the nature of the outer layer 26*b* of the protective element 26.

If desired the invention may be employed to attach a metal protective element 26 to the insulating material of the lining, where such element is required to provide physical protection in furnaces where high velocity air impinges upon the furnace lining, which may carry sand or another hostile substance.

The protective layer 26 (or layers) could in another application comprise a simple blanket of textile material for dust suppression, or could comprise a high grade insulating material such as one of the aluminum based fibrous insulators. Thus a single protective element 26 may be provided for each module 12, or the protective element 26 or a layer of it, may span several modules 12, or more than one protective element 26 may be required for each module 12.

In another module 12 construction, instead of comprising folds, the modules 12 may be made up of cut sheets of fibrous material, or may even comprise a vacuum formed ceramic fibre block of material as desired.

The embedded member 25 need not comprise a plate as described but could be of other configurations, such as a long spike, with a female threaded opening provided thereby.

Referring to FIGS. 6 and 6*a* there is shown an alternative member 25*a* which is adapted to be embedded in the insulating material of a furnace lining. The member 25*a* is similar to the member 25 shown in FIG. 4 but there are provided a pair of radiused edges 50,51, and the female threaded opening 31*a* thereof need not be sufficiently large to permit a tool such as tool 21 to pass therethrough.

The member 25*a* is adapted to be embedded in the insulating material 12 by being forced into the material and then rotated. The member 25*a* is generally elongate having a longitudinal axis L. Preferably where the insulating material comprises a folded insulation blanket, the axis L of the member 25 is generally aligned with the folds to facilitate insertion into the material, and when rotated the member 25*a* extends transversely to the folds for maximum pull out resistance.

A tool 21*a* is used to insert and rotate the member 25*a,* the tool 21*a* having a pair of prongs 52 which are receivable in corresponding openings 53 provided in the member 25*a*. Thus, when the member 25*a* is embedded, the tool 21*a* may be removed, and the member will operate substantially as member 25 described above.

Referring to FIGS. 7 and 7*a,* another embodiment 25*b* of member which is adapted to be embedded in the insulating material of the furnace lining is shown. The member 25*b* is, like member 25*a* described above with reference to FIGS. 6 and 6*a,* adapted to be embedded in the insulating material by being forced therein and rotated. However, the member 25*b* of FIG. 7 has a shank 28*b* which in use extends towards the hot face of the furnace lining. This shank 28*b* is, in the example shown, attached to the remainder of the embedded member 25*b,* by means of co-operating screw threads, in this example the shank 28*b* having a male thread 55 engageable in a female threaded socket 56 of the member 25*b,* although in another arrangement, the shank 28*b* could comprise a female threaded part engageable with a male threaded part of the embedded member 25*b*.

Thus the shank 28*b* may be used to insert the member 25*b* and rotate the member 25*b* thus to embed the member 25*b* in the insulating material. In this example, the shank 28*b* projects from the hot face 20*b* of the lining and a protective element 26*b,* (which is shown for illustrative purposes in FIG. 7*a* as a ceramic bat but could comprise another protective element as described above) is positioned over the projecting shank 28*b* so that the shank 28*b* passes through an opening in the protective element 26*b*. A securing means comprising a female threaded fastener 27*b* is received on the male threaded shank 28*b* to secure the protective element 26*b* to the hot face 20*b*.

In another arrangement such as indicated below with reference to FIGS. 8 and 8*a,* the shank 28*b* could be integral with the remainder of the embedded member 25*b,* or a tool may be used embed the member 25*b* which is subsequently removed and the shank 28*b* then engaged with the embedded member 25*b*.

In yet another arrangement, the shank 28*b* attached to or integral with the remainder of the embedded member 25*b,* may be shorter than as shown in FIG. 7*a* and the securing means 27*b* may have a shank part which passes through the protective element 26*b,* and a head part to retain the protective element 26*b* between the head part and the hot face 20*b*. The shank part of the securing means 27*b* may co-operate with the shorter shank 28*b* attached to or integral with the embedded member 25*b,* for example they may have co-operating threads. In yet another arrangement, the embedded member 25*b* may have a simple opening or socket, with which a shank part of the securing means may co-operate, e.g. by both being provided with opposite screw threads.

Of course, an embedded member with an integral shank, or a socket, may be embedded in the material of the furnace lining during manufacture e.g. of the modules or blocks rather than being embedded by being forced into the insulating material and rotated.

Referring now to FIGS. 8 and 8*a* yet another embodiment is illustrated. In this embodiment, a member adapted to be embedded in the insulating material 12 is shown at 25*c,* which member 25*c* has a shank 28*c* with, in this example, two plate-like transversely extending elongate parts indicated at P1 and P2. In this example the shank 28*c* and the two elongate parts P1, P2 are integrally provided but the two parts may be connected to the shank 28*c* as desired.

Each of the transversely extending plate-like parts P1, P2 has relatively sharp end edges 60, 61 which facilitate cutting through and separating the fibrous material of the insulating material 12 as the member 25*c* is rotated subsequent to having been thrust into the fibrous material with elongate axes L1, L2 of the elongate parts P1, P2 in alignment with the folds of the insulating material, 12, where provided.

To achieve the relatively sharp end edges 60, 61, preferably the elongate parts P1, P2 are tapered both axially along the respective parts P1, P2, and also across the widths of the parts P1, P2, ad indicated by the edges 62,64 indicated in FIG. 8*a*.

It will be appreciated that an embedded member like that shown in FIGS. 8 and 8*a* may in an alternative arrangement have a single plate-like part P1 or P2 instead of the two shown.

As with the arrangements of FIGS. 7 and 7*a,* the shank 25*c* of the embedded member of FIGS. 8 and 8*a* has a male thread which is adapted to co-operate with a female threaded securing member (not shown).

In each of the embodiments described above, the protective element 26, 26*a*, 26*b*, 26*c* is described as being secured to the hot face 20 of the lining. In another embodiment, alternatively or additionally, a protective element 26 is secured at the cold face of the lining which is at or adjacent the furnace wall 11.

The cold face is indicated at C in the figures. The protective element 26 etc. is provided at the cold face C for the purpose of protecting the furnace wall 11 from the environment of the furnace, where there is a risk that the environment could damage the furnace wall 11.

Such protective element 26 etc. may be secured at the cold face C by a fastener means which cooperates with an embedded member 25, 25*a*, 25*b*, 25*c* in exactly the same manner as described above for the hot face 20.

During lining construction, the protective element 26 etc. may be inserted between the furnace wall 11 and the cold face C of the insulating material 12, but once the furnace lining is constructed, if it is desired to secure a protective element 26 etc. at the cold face C, either substantial dismantling of the lining construction would be required, or else part of the furnace wall 11 may be removed outwardly to permit the protective element 26 etc. to be positioned. Thus the application of the invention for securing a protective element at the cold face is more applicable during furnace lining construction whereas to secure the protective element or elements 26 to the hot face 20 of the lining may readily be achieved both during lining construction or subsequently.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A lining for a furnace the lining having insulating material attached to an inside wall of the furnace, the insulating material in use having a hot face which faces inwardly of the furnace and a cold face at or adjacent the furnace wall, wherein a protective element is provided at least partially to cover the hot face, the protective element being secured relative to the hot face by a securing means which co-operates with a member which is embedded in the insulating material, wherein the furnace lining includes a plurality of individual blocks or modules of insulating material, each attached at the inside wall of the furnace, each module including a ceramic blanket which is folded into a block with the folds extending transversely to the furnace wall, and wherein the member which is embedded in the lining is embedded in at least one of the individual blocks so as to extend generally transversely to the folds.

2. A lining according to claim 1 wherein the embedded member is embedded in the lining by being forced into the lining material and then being rotated.

3. A lining according to claim 2 wherein the embedded member includes a generally elongate part.

4. A lining according to claim 3 wherein the lining includes a ceramic blanket which is folded into a block, with the folds extending transversely to the furnace wall and the embedded member is forced into the insulating material with an elongate axis of the elongate part in an orientation generally aligned with the folds and is then rotated generally about an axis which is transverse to the elongate axis so that the elongate axis extends generally transverse to the folds.

5. A lining according to claim 3 wherein the embedded member is of at least a single plate construction and is made of a material which is sufficiently strong to resist pull-out forces.

6. A method of lining a furnace wall include the steps of attaching insulating material at or adjacent a wall of the furnace, the insulating material in use having a hot face which faces inwardly of the furnace and a cold face at or adjacent the furnace wall, and wherein the method includes embedding in the insulating material a member which is adapted to co-operate with a securing means, providing a protective element at least partially to cover the hot face, securing the protective element to the hot face by attaching the securing means to the embedded member, wherein the furnace is modular having a plurality of modules or blocks of insulating material, wherein the method includes covering a substantial part of the furnace wall by a plurality of protective elements each secured at the hot face of the insulating material to at least one individual module, by means including a securing means which co-operates with a member which is embedded in the insulating material, wherein the embedded member is embedded in the insulating material by forcing the member into the insulating material and then rotating the member, and wherein the method includes inserting the member to be embedded when in an orientation generally aligned with folds in the insulating material and then rotating the member so that the member extends transversely to the folds.

7. A method of repairing a lining of a furnace made by a method including the steps of attaching insulating material at or adjacent a wall of the furnace, the insulating material in use having a hot face which faces inwardly of the furnace and a cold face at or adjacent the furnace wall, and wherein the method includes embedding in the insulating material, a member which is adapted to co-operate with a securing means, providing a protective element at least partially to cover the hot face, securing the protective element to the hot face by attaching the securing means to the embedded member and wherein the embedded member is embedded in the insulating material by forcing the member into the insulating material and then rotating the member, which repair method includes the steps of removing the securing means, removing at least a layer of the protective element, and securing at least a replacement protective element layer to the hot face of the insulating material by a securing means which co-operates with a member which is embedded in the insulating material.

* * * * *